US009975170B2

(12) United States Patent
Ha et al.

(10) Patent No.: US 9,975,170 B2
(45) Date of Patent: May 22, 2018

(54) METHOD FOR MANUFACTURING DUPLEX STAINLESS STEEL SHEET HAVING HIGH NITROGEN CONTENT AND GOOD SURFACE QUALITY

(71) Applicant: POSCO, Pohang-si (KR)

(72) Inventors: Man Jin Ha, Pohang-si (KR); Jin Ho Kim, Pohang-si (KR); Suk Kyun Hwang, Pohang-si (KR); Sung Jin Park, Pohang-si (KR)

(73) Assignee: POSCO, Pohang-si (KR)

( * ) Notice: Subject to any disclaimer, the term of this patent is extended or adjusted under 35 U.S.C. 154(b) by 146 days.

(21) Appl. No.: 14/954,218

(22) Filed: Nov. 30, 2015

(65) Prior Publication Data

US 2016/0167120 A1 Jun. 16, 2016

(30) Foreign Application Priority Data

Dec. 11, 2014 (KR) ..... 10-2014-0178488
Nov. 9, 2015 (KR) ..... 10-2015-0156701

(51) Int. Cl.

| | |
|---|---|
| ***B22D 11/00*** | (2006.01) |
| ***B22D 11/06*** | (2006.01) |
| ***B22D 11/117*** | (2006.01) |
| ***C22C 38/58*** | (2006.01) |
| ***C22C 38/02*** | (2006.01) |
| ***C22C 38/00*** | (2006.01) |

(52) U.S. Cl.

CPC ..... *B22D 11/117* (2013.01); *B22D 11/002* (2013.01); *B22D 11/0622* (2013.01); *C22C 38/001* (2013.01); *C22C 38/02* (2013.01); *C22C 38/58* (2013.01)

(58) Field of Classification Search

CPC ..... B22D 11/002; B22D 11/0622
USPC ..... 164/480
See application file for complete search history.

(56) References Cited

U.S. PATENT DOCUMENTS 5,259,443 A * 11/1993 Osada ..... B22D 11/06 164/428
5,787,967 A * 8/1998 Vendeville ..... B22D 11/0622 164/154.1
2004/0025979 A1 2/2004 Bruckner et al.

FOREIGN PATENT DOCUMENTS

| | | |
|---|---|---|
| CN | 1659300 | 8/2005 |
| JP | 02232318 | 9/1990 |
| JP | 05212505 | 8/1993 |
| JP | 2010222695 | 10/2010 |
| KR | 20120074434 | 7/2012 |
| KR | 20130125071 A * | 11/2013 |
| KR | 1020130135575 | 12/2013 |
| KR | 20140005499 | 1/2014 |
| KR | 20140069945 | 6/2014 |
| WO | 2012143610 | 10/2012 |

(Continued)

OTHER PUBLICATIONS

EPO machine translation of CN 103987867 (Equivalent of WO2013081422), Aug. 13, 2014.*

(Continued)

*Primary Examiner* — Kevin E Yoon
(74) *Attorney, Agent, or Firm* — Cantor Colburn LLP

(57) ABSTRACT

There is provided a method of manufacturing a high nitrogen duplex stainless steel sheet through a twin roll strip casting process without the occurrence of surface swelling on the high nitrogen duplex stainless steel sheet.

6 Claims, 4 Drawing Sheets

(56) References Cited

FOREIGN PATENT DOCUMENTS

| | | | | |
|---|---|---|---|---|
| WO | WO 2012143610 A1 * | 10/2012 | ..... | C21D 1/26 |
| WO | WO 2013081422 A1 * | 6/2013 | ..... | C21D 8/00 |

OTHER PUBLICATIONS

EPO machine translation of KR 101286213 (Equivalent of KR 20120074434), Jul. 23, 2013.*

Chinese Office Action—Chinese Application No. 201510921116.3 dated Feb. 20, 2017, citing JP 2-232318, JP 5-212505, CN 1659300, KR 10-1372741, KR 10-2013-0135575 and KR 10-2014-0005499.

Korean Office Action—Korean Application No. 10-2015-0156701 dated Dec. 20, 2016, citing KR 10-2014-0069945 and KR 10-2012-0074434.

Chinese Office Action—Chinese Application No. 201510921116.3 dated Oct. 16, 2017, citing KR 10-2014-0005499, Ding and Tang.

Ding, Analysis and Dynamic Simulation of Strip Casting Process Parameter, China manufacturing industry informatization, vol. 36 No. 13, pp. 75-77.

Tang, The solubility of nitrogen in steel and alloy, <high alloy steel wire>, Metallurgical Industry Press, pp. 262-263.

* cited by examiner

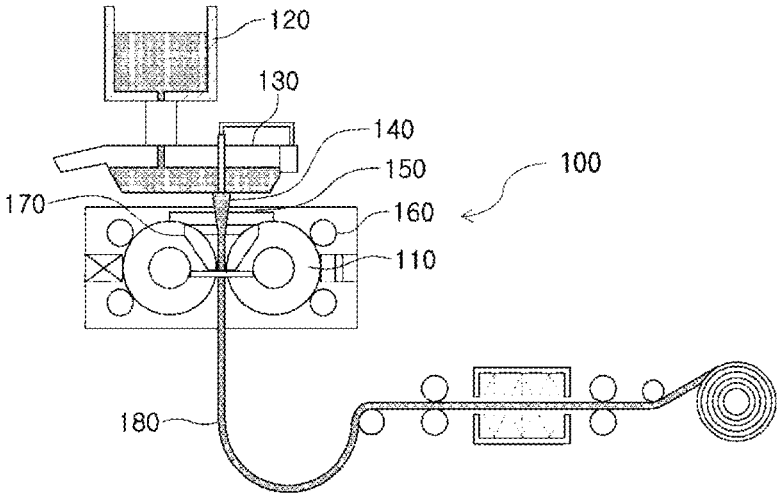
FIG. 1 *Prior Art*

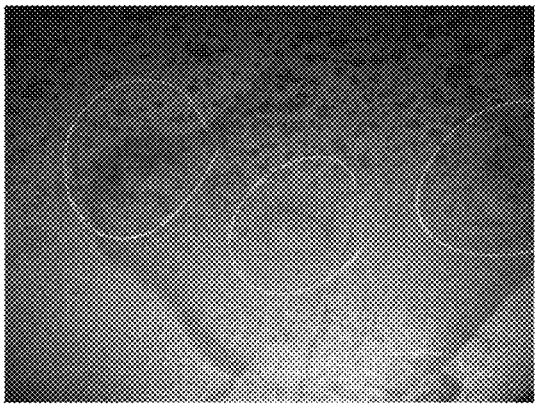
FIG. 2 *Prior Art*

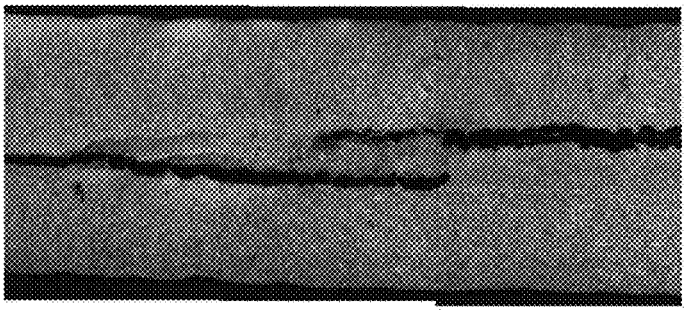
FIG. 3A *Prior Art*
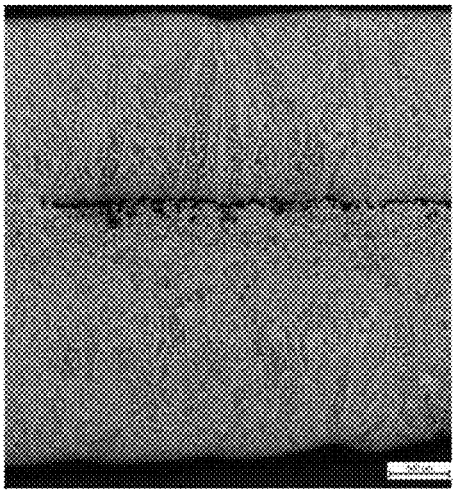
FIG. 3B *Prior Art*

METHOD FOR MANUFACTURING DUPLEX STAINLESS STEEL SHEET HAVING HIGH NITROGEN CONTENT AND GOOD SURFACE QUALITY

CROSS-REFERENCE TO RELATED APPLICATION

This application claims the priorities and benefits of Korean Patent Application Nos. 10-2014-0178488 filed on Dec. 11, 2014 and 10-2015-0156701 filed on Nov. 9, 2015 with the Korean Intellectual Property Office, the disclosures of which are incorporated herein by reference.

BACKGROUND

The present disclosure relates to a duplex stainless steel sheet having a high nitrogen content, and, more particularly, to a method for manufacturing a duplex stainless steel sheet having a high nitrogen content and good surface quality through a twin roll casting process.

In general, a twin roll strip casting process refers to a process of directly and continuously producing a strip having a thickness of several millimeters (mm) from molten steel supplied between a pair of rotating casting rolls. Referring to FIG. 1, a twin roll strip caster 100 for twin roll strip casting generally includes casting rolls 110, a ladle 120, a tundish 130, a casting nozzle 140, a meniscus shield 150, brush rolls 160, and edge dams 170.

In a twin roll strip casting process, molten steel is supplied to the ladle 120, and the molten steel flows to the tundish 130 through a nozzle. Then, the molten steel is supplied from the tundish 130 to a region among the casting rolls 110 and the edge dams 170 attached to both ends of the casting rolls 110 through the casting nozzle 140, and the molten steel starts to solidify in the region. At this time, the meniscus shield 150 protects the surface of the molten steel solidifying in the region between the casting rolls 110 so as to prevent oxidation, and a proper gas is supplied to control the atmosphere of the region. In this state, while the molten steel solidifies, the molten steel is drawn from the region through a gap between the casting rolls 110 as a strip 180.

However, when a high nitrogen duplex stainless steel sheet is manufactured through such a twin roll casting process, the solubility of nitrogen in molten steel varies as the molten steel solidifies, and thus nitrogen gas is generated from the molten steel. This may cause surface swelling as illustrated in FIG. 2, in which an image of a duplex stainless steel sheet is illustrated.

The duplex stainless steel sheet having surface swelling illustrated in FIG. 2 may have central cracks in the swelling region as illustrated in a cross-sectional view of FIG. 3A. In addition, as illustrated in FIG. 3B, pores may be densely formed in a middle portion of the duplex stainless steel sheet in a region in which the duplex stainless steel sheet swells slightly. Thus, it may be understood that such swelling occurs when nitrogen gas is generated and expanded in a middle portion of a steel sheet.

Nitrogen has a relatively high solubility on the level of 2500 ppm to 3500 ppm in molten high nitrogen duplex stainless steel, but has a relatively low solubility on the level of 1200 ppm in solid high nitrogen duplex stainless steel. Therefore, if molten duplex stainless steel having a nitrogen content of 2500 ppm is slowly solidified, nitrogen gas may be generated in an amount corresponding to the solubility difference, 1300 ppm, and many pores may be formed in the duplex stainless steel as the nitrogen gas expands.

Due to these reasons, it is difficult to perform a general continuous casting process or ingot casting process on high nitrogen duplex stainless steel. However, in a twin roll strip casting process, the generation of bubbles may be reduced by rapid cooling, and thus a twin roll strip casting method may be applied to high nitrogen duplex stainless steel. However, even in a twin roll strip casting process, if the content of nitrogen in molten steel is high, surface swelling may occur due to the generation of nitrogen gas as illustrated in FIGS. 2, 3A, and 3B. Therefore, techniques for solving these problems are necessary.

SUMMARY

An aspect of the present disclosure may provide a method of manufacturing a duplex stainless steel sheet having a high nitrogen content and good surface quality through a twin roll strip casting process.

According to an aspect of the present disclosure, there is provided a method of manufacturing a duplex stainless steel sheet having a high nitrogen content and good surface quality through a twin roll strip casting process by supplying molten steel between two casting rolls rotating in opposite directions, the method including: before the molten steel is supplied to the casting rolls, maintaining the nitrogen content of the molten steel at 2500 ppm or less, the molten steel including, by wt %, carbon (C): 0.02% to 0.06%, chromium (Cr): 19.0% to 21.0%, manganese (Mn): 2.8% to 3.2%, silicon (Si): 0.55% to 0.8%, nickel (Ni): 0.5% to 1.5%, nitrogen (N): 2200 ppm or greater, and a balance of iron (Fe) and inevitable impurities.

According to another aspect of the present disclosure, there is provided a method of manufacturing a duplex stainless steel sheet having a high nitrogen content and good surface quality through a twin roll strip casting process by supplying molten steel between two casting rolls rotating in opposite directions, the method including: before the molten steel is supplied to the casting rolls, increasing the temperature of the molten steel by 2° C. or greater based on 1520° C. each time the nitrogen content of the molten steel increases by 10 ppm from 2500 ppm, the molten steel including, by wt %, carbon (C): 0.02% to 0.06%, chromium (Cr): 19.0% to 21.0%, manganese (Mn): 2.8% to 3.2%, silicon (Si): 0.55% to 0.8%, nickel (Ni): 0.5% to 1.5%, nitrogen (N): 2200 ppm or 2700 ppm, and a balance of iron (Fe) and inevitable impurities.

BRIEF DESCRIPTION OF DRAWINGS

The above and other aspects, features, and advantages of the present disclosure will be more clearly understood from the following detailed description taken in conjunction with the accompanying drawings, in which:

FIG. 1 is a schematic view illustrating a general twin roll strip caster;

FIG. 2 is an image illustrating surface swelling of a high nitrogen duplex stainless steel manufactured by a method of the related art;

FIG. 3A is an image illustrating a cross section of a swollen portion of the high nitrogen duplex stainless steel illustrated in FIG. 2;

FIG. 3B is an image illustrating a cross section of a slightly swollen portion of the high nitrogen duplex stainless steel illustrated in FIG. 2;

DETAILED DESCRIPTION

Figure 4:
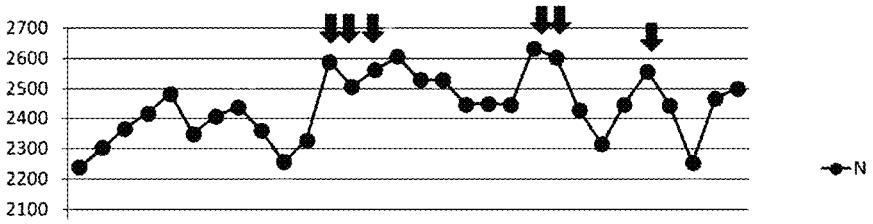
FIG. 4 is a graph illustrating surface swelling of high nitrogen duplex stainless steel sheets according to the content of nitrogen in molten steel.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the present invention to those skilled in the art.

In the drawings, the shapes and dimensions of elements may be exaggerated for clarity, and the same reference numerals will be used throughout to designate the same or like elements.

The present disclosure relates to a method for manufacturing a duplex stainless steel sheet having a high nitrogen content and good surface quality through a twin roll strip casting process while preventing lamination defects caused by surface swelling.

Compared to the nitrogen content of general duplex stainless steel sheets, the nitrogen content of the high nitrogen duplex stainless steel sheet of the present disclosure is increased to a range of 2200 ppm to 2700 ppm to properly increase the stability of austenite and adjust the rate of martensite formation during deformation for increasing the elongation of the duplex stainless steel sheet to 40% or greater and improving the formability of the duplex stainless steel sheet. To this end, a technique for adding a large amount of nitrogen is used for the nitrogen duplex stainless steel sheet.

In a method of manufacturing a duplex stainless steel sheet having a high nitrogen content and good surface quality according to an exemplary embodiment, the nitrogen content of molten steel is maintained to be 2500 ppm or less before the molten steel is supplied to casting rolls. The molten steel includes, by wt %, carbon (C): 0.02% to 0.06%, chromium (Cr): 19.0% to 21.0%, manganese (Mn): 2.8% to 3.2%, silicon (Si): 0.55% to 0.8%, nickel (Ni): 0.5% to 1.5%, nitrogen (N): 2200 ppm or greater, and a balance of iron (Fe) and inevitable impurities.

According to the exemplary embodiment, when the high nitrogen duplex stainless steel sheet is manufactured through a twin roll strip casting process, the nitrogen content of the molten steel is maintained to be 2500 ppm or less before the molten steel is supplied to casting rolls, so as to prevent surface swelling of the high nitrogen duplex stainless steel. The nitrogen content of the molten steel may be 3000 ppm or greater. In this case, however, when the molten steel solidifies, solid ferrite in which the solubility of nitrogen is 1200 ppm may be formed, and the remaining nitrogen may be segregated in the molten steel. If the nitrogen content of the molten steel increases to a certain degree, nitrogen gas may be generated in the molten steel, and if the pressure of the nitrogen gas is greater than the static pressure of the molten steel, the nitrogen gas may expand and form nitrogen pinholes. That is, if the nitrogen content of the molten steel is approximately two times the solubility of nitrogen in ferrite, that is, the nitrogen content of the molten steel is within the range of about 2400 ppm to 2500 ppm, nitrogen gas may be generated from nitrogen segregated in the molten steel, and the pressure of the nitrogen gas may become greater than the static pressure of the molten steel.

In a method of manufacturing a high nitrogen duplex stainless steel sheet having a high nitrogen content and good surface quality according to another exemplary embodiment, before molten steel having the above-described composition is supplied to the casting rolls, the temperature of the molten steel may preferably be increased from 1520° C. by 2° C. or higher, and more preferably by 2° C. each time the nitrogen content of the molten steel increases by 10 ppm from 2500 ppm.

If the nitrogen content of the molten steel is maintained to be 2500 ppm or less, surface swelling may not occur on the high nitrogen duplex stainless steel sheet manufactured using the molten steel. However, if the nitrogen content of the molten steel is greater than 2500 ppm, the material properties and corrosion resistance of the high nitrogen duplex stainless steel sheet may be improved. Therefore, the temperature of the molten steel may be increased to increase the solubility of nitrogen in the molten steel, that is, to increase the nitrogen content of the molten steel. Preferably, each time the nitrogen content of the molten steel is increased by 10 ppm from 2500 ppm, the temperature of the molten steel may be increased by 2° C. or greater, and more preferably by 2° C. If the temperature of the molten steel is increase at the above-mentioned rate, the formation of columnar grain boundaries may be delayed during a twin roll strip casting process. In other words, if columnar grain boundaries are formed because the temperature of the molten steel is low, nitrogen may be concentrated in regions around the columnar grain boundaries, causing the generation and expansion of nitrogen bubbles. However, if the temperature of the molten steel is high enough to prevent the formation of columnar grain boundaries, nitrogen may be dissolved in the molten steel, and nitrogen gas may not be generated. In this state, if the molten steel is rapidly cooled without generating nitrogen gas, surface swelling may also be prevented. When the nitrogen content of the molten steel is 2500 ppm or less, the temperature of the molten steel may preferably be 1520° C. or higher. When the nitrogen content of the molten steel is 2505 ppm, it may be preferable that the temperature of the molten steel be increased by 1° C. to 1521° C., and when the nitrogen content of the molten steel is 2510 ppm, it may be preferable that the temperature of the molten steel be increased by 2° C. to 1522° C. In addition, when the nitrogen content of the molten steel is 2520 ppm, it may be preferable that the temperature of the molten steel be increased by 4° C. to 1524° C.

In the exemplary embodiment, the upper limit of the temperature of the molten steel may preferably be 1540° C.

That is, although the temperature of the molten steel is increased by 2° C. or greater each time the nitrogen content of the molten steel is increased by 10 ppm from 2500 ppm, the temperature of the molten steel may not exceed 1540° C.

If the temperature of the molten steel exceeds 1540° C., a strip formed by casting the molten steel may likely have edge defects.

When the nitrogen content of the molten steel is 2500 ppm or greater, rolling force of the casting rolls may be increased by 25% or greater compared to when the nitrogen content of the molten steel is less than 2500 ppm. When the nitrogen content of the molten steel is 2500 ppm or greater, if the temperature of the molten steel is increased at the above-described rate, surface swelling of the high nitrogen duplex stainless steel sheet may be prevented. In this case, if the rolling force of the casting rolls of a twin roll strip caster is increased, surface swelling of the high nitrogen duplex stainless steel sheet may be more effectively prevented. When the nitrogen content of the molten steel is less than 2500 ppm, the rolling force of the casting rolls may be 8 tons across the entire width of the casting rolls. That is, for example, when the nitrogen content of the molten steel is less than 2500 ppm and the width of the casting rolls is 1312 mm, the rolling force of the casting rolls may be 8 tons across the width, 1312 mm, of the casting rolls, and when the nitrogen content of the molten steel is 2500 ppm or greater, the rolling force of the casting rolls may be increased by 25% to 10 or more tons across the width, 1312 mm, of the casting rolls.

If the rolling force of the casting rolls is approximately 8 tons as described above, the molten steel may uniformly solidify across the width of the casting rolls. The rolling force of the casting rolls may be increased by 25% to 10 tons by decreasing the rotating speed of the casting rolls while maintaining a gap between the casting rolls. If the rolling force of the casting rolls is increased as described above, the rate of casting is decreased. Thus, shells solidifying on the two casting rolls may have a relatively increased thickness, and the rigidity of the shells and the adhesion between the shells may be increased. If the adhesion between the shells is increased as described above, pressure caused by the expansion of nitrogen gas may be overcome, and thus surface swelling may be prevented.

Since surface swelling of the high nitrogen duplex stainless steel sheet occurs when the pressure of nitrogen gas concentrated in a middle region of the high nitrogen duplex stainless steel sheet overcomes the strength of the high nitrogen duplex stainless steel sheet and lifts the surface of the high nitrogen duplex stainless steel sheet, if the rolling force of the casting rolls is increased at the above-described rate when the temperature of the molten steel is increased, surface swelling of the high nitrogen duplex stainless steel sheet may be more effectively prevented.

Hereinafter, the present disclosure will be described more specifically through examples.

Example 1

A process of manufacturing a high nitrogen duplex stainless steel sheet was performed 32 times using molten steel having a nitrogen content as illustrated in FIG. 4 and the twin roll strip caster 100 illustrated in FIG. 1, and the occurrence of surface swelling was observed. Results of the observation were illustrated in FIG. 4 in which nitrogen content resulting in surface swelling was indicated with arrows. The molten steel included, by wt %, carbon (C): 0.03%, chromium (Cr): 20.0%, manganese (Mn): 3.1%, silicon (Si): 0.7%, nickel (Ni): 1.2%, and a balance of iron (Fe) and inevitable impurities. In addition, the temperature of the molten steel was maintained to be within the range of 1525° C.±5° C., and the rolling force of the casting rolls 110 was 8 tons. As a result, when the nitrogen content of the molten steel was 2500 ppm or less as proposed in the present disclosure, surface swelling did not occur. However, when the nitrogen content of the molten steel was greater than 2500 ppm, surface swelling occurred.

Example 2

Molten steel including, by wt %, carbon (C): 0.03%, chromium (Cr): 20.0%, manganese (Mn): 3.1%, silicon (Si): 0.7%, nickel (Ni): 1.2%, and a balance of iron (Fe) and inevitable impurities was prepared. The nitrogen content and temperature of the molten steel was adjusted as illustrated in Table 1, and high nitrogen duplex stainless steel sheets were manufactured using the molten steel and the twin roll strip caster 100 illustrated in FIG. 1. Then, surface swelling of the high nitrogen duplex stainless steel sheets was observed as illustrated in Table 1. Results illustrated in Table 1 were plotted in FIG. 5.

TABLE 1

| NO. | Nitrogen Content in Molten Steel (ppm) | Temperature of Moletn Steel (° C.) | Rolling Force of Casting Rolls (tons) | Surface Swelling |
|---|---|---|---|---|
| *IS 1 | 2500 | 1540 | 8 | Did Not Occur |
| **CS 1 | 2600 | 1535 | 8 | Occurred |
| CS 2 | 2520 | 1525 | 8 | Occurred |
| IS 2 | 2560 | 1530 | 8 | Did Not Occur |
| IS 3 | 2600 | 1540 | 8 | Did Not Occur |
| IS 4 | 2520 | 1530 | 8 | Did Not Occur |
| CS 3 | 2520 | 1515 | 8 | Occurred |
| CS 4 | 2620 | 1523 | 8 | Occurred |
| CS 5 | 2600 | 1525 | 8 | Occurred |
| CS 6 | 2550 | 1520 | 8 | Occurred |
| IS 5 | 2500 | 1520 | 8 | Did Not Occur |

*IS: Inventive Sample,
**CS: Comparative Sample

Figure 5:
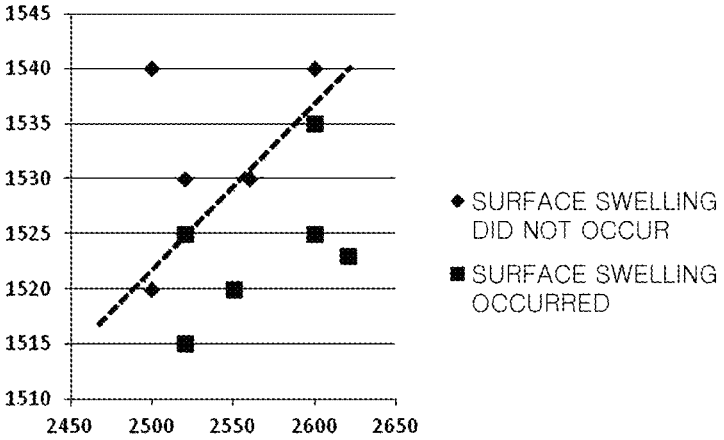
FIG. 5 is a graph illustrating surface swelling of high nitrogen duplex stainless steel sheets according to the content of nitrogen in molten steel and the temperature of the molten steel.

As illustrated in Table 1 and FIG. 5, when the nitrogen content of the molten steel was 2500 ppm or greater, the occurrence of surface swelling could be prevented by adjusting the temperature of the molten steel as proposed in the present disclosure (Inventive Samples 1 to 5). However, when the nitrogen content of the molten steel was greater than 2500 ppm and the temperature of the molten steel was adjusted within a range not proposed in the present disclosure (Comparative Samples 1 to 6), surface swelling occurred.

Example 3

Molten steel including, by wt %, carbon (C): 0.03%, chromium (Cr): 20.0%, manganese (Mn): 3.1%, silicon (Si): 0.7%, nickel (Ni): 1.2%, and a balance of iron (Fe) and inevitable impurities was prepared. The nitrogen content and temperature of the molten steel was adjusted as illustrated in Table 2, and high nitrogen duplex stainless steel sheets were manufactured using the molten steel and the twin roll strip caster 100 illustrated in FIG. 1 while adjusting the rolling force of the casting rolls 110 as illustrating in Table 2. Then, surface swelling of the high nitrogen duplex stainless steel sheets were observed as illustrated in Table 2.

TABLE 2

| No | Nitrogen Content in Molten Steel (ppm) | Temperature of Moletn Steel (° C.) | Rolling Force of Casting Rolls (tons) | Surface Swelling |
|---|---|---|---|---|
| **CS 7 | 2550 | 1520 | 1312 mm/8 tons | Occurred |
| *IS 6 | 2500 | 1520 | 1312 mm/10 tons (incresed by 25%) | Did Not Occur |
| IS 7 | 2500 | 1520 | 1312 mm/12 tons (incrreased by 50%) | Did Not Occur |

*IS: Inventive Sample,
**CS: Comparative Sample

As illustrated in Table 2, when the casting rolls 110 applied a rolling force of 8 tons to the high nitrogen duplex stainless steel sheet (Comparative Sample 7) across the width, 1312 mm, of the casting rolls 110, surface swelling was observed from the high nitrogen duplex stainless steel sheet. However, when the rolling force of the casting rolls 110 was increased to 10 tons and 12 tons (Inventive Samples 6 and 7), swelling could more effectively be prevented.

As set forth above, according to exemplary embodiments, a high nitrogen duplex stainless steel sheet may be manufactured through a twin roll strip casting process without the occurrence of surface swelling on the high nitrogen duplex stainless steel sheet.

While exemplary embodiments have been shown and described above, it will be apparent to those skilled in the art that modifications and variations could be made without departing from the scope of the present invention as defined by the appended claims.

What is claimed is:

1. A method of manufacturing a duplex stainless steel sheet having an increased nitrogen content and an improved surface quality through a twin roll strip casting process by supplying a molten steel between two casting rolls rotating in opposite directions, the method comprising:

preparing a molten steel comprising, by wt %, carbon (C): 0.02% to 0.06%, chromium (Cr): 19.0% to 21.0%, manganese (Mn): 2.8% to 3.2%, silicon (Si): 0.55% to 0.8%, nickel (Ni): 0.5% to 1.5%, nitrogen (N): more than 2500 ppm, and a balance of iron (Fe) and inevitable impurities;

measuring a nitrogen content of the prepared molten steel;

increasing a temperature of the prepared molten steel in proportion to the measured nitrogen content to form a temperature-increased molten steel; and supplying the temperature-increased molten steel to between two casting rolls rotating in opposite directions to form a duplex stainless steel sheet having an increased nitrogen content.

2. The method of claim 1, wherein when the nitrogen content of the prepared molten steel is more than 2500 ppm to 3000 ppm or less, and the temperature of the temperature-increased molten steel is 1520° C. or higher.

3. The method of claim 2, wherein the increasing comprises: increasing the temperature of the prepared molten steel by 2° C. or more each time the measured nitrogen content is increased by 10 ppm.

4. The method of claim 3, wherein the temperature of the temperature-increased molten steel is 1520° C. to 1540° C.

5. The method of claim 1, wherein the increasing comprises: increasing the temperature of the prepared molten steel by 2° C. or more each time the measured nitrogen content is increased by 10 ppm.

6. The method of claim 5, wherein the temperature of the temperature-increased molten steel is 1520° C. to 1540° C.

* * * * *